US011391506B2

(12) United States Patent
Beckner et al.

(10) Patent No.: US 11,391,506 B2
(45) Date of Patent: Jul. 19, 2022

(54) MACHINE COMPARTMENT FOR A VACUUM INSULATED STRUCTURE

(71) Applicant: WHIRLPOOL CORPORATION, Benton Harbor, MI (US)

(72) Inventors: Jeffrey P. Beckner, Niles, MI (US); Paul B. Allard, Coloma, MI (US); Lynne F. Hunter, Dorr, MI (US); Gustavo Frattini, St. Jospeh, MI (US); Abhay Naik, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 207 days.

(21) Appl. No.: 16/306,640

(22) PCT Filed: Aug. 18, 2016

(86) PCT No.: PCT/US2016/047558

§ 371 (c)(1),
(2) Date: Dec. 3, 2018

(87) PCT Pub. No.: WO2018/034665

PCT Pub. Date: Feb. 22, 2018

(65) Prior Publication Data

US 2019/0137167 A1 May 9, 2019

(51) Int. Cl.
*F25D 23/06* (2006.01)
*F25D 23/00* (2006.01)

(52) U.S. Cl.
CPC ..... *F25D 23/066* (2013.01); *F25D 23/006* (2013.01); *F25D 23/062* (2013.01); *F25D 2201/14* (2013.01)

(58) Field of Classification Search
CPC ..... F25D 23/066; F25D 23/065; F25D 23/062
See application file for complete search history.

(56) References Cited

U.S. PATENT DOCUMENTS 948,541 A 2/1910 Coleman
1,275,511 A 8/1918 Welch
(Continued)

FOREIGN PATENT DOCUMENTS

CA 626838 A 5/1961
CA 1320631 7/1993
(Continued)

OTHER PUBLICATIONS

Cai et al., "Generation of Metal Nanoparticles by Laser Ablation of Microspheres," J. Aerosol Sci., vol. 29, No. 5/6 (1998), pp. 627-636.
(Continued)

*Primary Examiner* — Kimberley S Wright
(74) *Attorney, Agent, or Firm* — Price Heneveld LLP

(57) ABSTRACT

A refrigerator cabinet is provided that includes an inner liner and an external wrapper. The inner liner is positioned within the external wrapper such that a gap is defined between the external wrapper and inner liner. The external wrapper includes a machine compartment including: a top wall, an interior wall, a bottom wall, a first side wall and a second side wall. A foot is defined by the external wrapper and is positioned below the machine compartment. The foot is at least partially defined by the bottom wall and at least partially supports the refrigerator cabinet.

8 Claims, 4 Drawing Sheets

(56) References Cited

U.S. PATENT DOCUMENTS 1,849,369 A 3/1932 Frost
1,921,576 A 8/1933 Muffly
2,108,212 A 2/1938 Schellens
2,128,336 A 8/1938 Torstensson
2,164,143 A 6/1939 Munters
2,191,659 A 2/1940 Hintze
2,318,744 A 5/1943 Brown
2,356,827 A 8/1944 Coss
2,432,042 A 12/1947 Richard
2,439,602 A 4/1948 Heritage
2,439,603 A 4/1948 Heritage
2,451,884 A 10/1948 Stelzer
2,538,780 A 1/1951 Hazard
2,559,356 A 7/1951 Hedges
2,729,863 A 1/1956 Kurtz
2,768,046 A 10/1956 Evans
2,817,123 A 12/1957 Jacobs
2,942,438 A 6/1960 Schmeling
2,985,075 A 5/1961 Knutsson-Hall
3,086,830 A 4/1963 Malia
3,125,388 A 3/1964 Costantini et al.
3,137,900 A 6/1964 Carbary
3,218,111 A 11/1965 Steiner
3,258,883 A 7/1966 Louis et al.
3,290,893 A 12/1966 Haldopoulos
3,338,451 A 8/1967 Kesling
3,353,301 A 11/1967 Heilweil et al.
3,353,321 A 11/1967 Heilweil et al.
3,358,059 A 12/1967 Snyder
3,379,481 A 4/1968 Fisher
3,408,316 A 10/1968 Mueller et al.
3,471,416 A 10/1969 Fijal
3,597,850 A 8/1971 Jenkins
3,607,169 A 9/1971 Coxe
3,632,012 A 1/1972 Kitson
3,633,783 A 1/1972 Aue
3,634,971 A 1/1972 Kesling
3,635,536 A 1/1972 Lackey et al.
3,670,521 A 6/1972 Dodge, III et al.
3,688,384 A 9/1972 Mizushima et al.
3,769,770 A 11/1973 Deschamps et al.
3,862,880 A 1/1975 Feldman
3,868,829 A 3/1975 Mann et al.
3,875,683 A 4/1975 Waters
3,910,658 A 10/1975 Lindenschmidt
3,933,398 A 1/1976 Haag
3,935,787 A 2/1976 Fisher
4,005,919 A 2/1977 Hoge et al.
4,006,947 A 2/1977 Haag et al.
4,043,624 A 8/1977 Lindenschmidt
4,050,145 A 9/1977 Benford
4,067,628 A 1/1978 Sherburn
4,170,391 A 10/1979 Bottger
4,242,241 A 12/1980 Rosen et al.
4,260,876 A 4/1981 Hochheiser
4,303,730 A 12/1981 Torobin
4,303,732 A 12/1981 Torobin
4,325,734 A 4/1982 Burrage et al.
4,330,310 A 5/1982 Tate, Jr. et al.
4,332,429 A 6/1982 Frick
4,396,362 A 8/1983 Thompson et al.
4,417,382 A 11/1983 Schilf
4,492,368 A 1/1985 DeLeeuw et al.
4,529,368 A 7/1985 Makansi
4,548,196 A 10/1985 Torobin
4,580,852 A * 4/1986 Smitte ..... F25D 23/062 312/406.2
4,583,796 A 4/1986 Nakajima et al.
4,660,271 A 4/1987 Lenhardt
4,671,909 A 6/1987 Torobin
4,671,985 A 6/1987 Rodrigues et al.
4,681,788 A 7/1987 Barito et al.
4,745,015 A 5/1988 Cheng et al.
4,777,154 A 10/1988 Torobin
4,781,968 A 11/1988 Kellerman
4,805,293 A 2/1989 Buchser
4,865,875 A 9/1989 Kellerman
4,870,735 A 10/1989 Jahr et al.
4,914,341 A 4/1990 Weaver et al.
4,917,841 A 4/1990 Jenkins
5,007,226 A 4/1991 Nelson
5,018,328 A 5/1991 Cur et al.
5,033,636 A 7/1991 Jenkins
5,066,437 A 11/1991 Barito et al.
5,082,335 A 1/1992 Cur et al.
5,084,320 A 1/1992 Barito et al.
5,094,899 A 3/1992 Rusek, Jr.
5,118,174 A 6/1992 Benford et al.
5,121,593 A 6/1992 Forslund
5,157,893 A 10/1992 Benson et al.
5,168,674 A 12/1992 Molthen
5,171,346 A 12/1992 Hallett
5,175,975 A 1/1993 Benson et al.
5,212,143 A 5/1993 Torobin
5,221,136 A 6/1993 Hauck et al.
5,227,245 A 7/1993 Brands et al.
5,231,811 A 8/1993 Andrepont et al.
5,248,196 A 9/1993 Lynn et al.
5,251,455 A 10/1993 Cur et al.
5,252,408 A 10/1993 Bridges et al.
5,263,773 A 11/1993 Gable et al.
5,273,801 A 12/1993 Barry et al.
5,318,108 A 6/1994 Benson et al.
5,340,208 A 8/1994 Hauck et al.
5,353,868 A 10/1994 Abbott
5,359,795 A 11/1994 Mawby et al.
5,375,428 A 12/1994 LeClear et al.
5,397,759 A 3/1995 Torobin
5,418,055 A 5/1995 Chen et al.
5,433,056 A 7/1995 Benson et al.
5,477,676 A 12/1995 Benson et al.
5,500,287 A 3/1996 Henderson
5,500,305 A 3/1996 Bridges et al.
5,505,810 A 4/1996 Kirby et al.
5,507,999 A 4/1996 Cospey et al.
5,509,248 A 4/1996 Dellby et al.
5,512,345 A 4/1996 Tsutsumi et al.
5,532,034 A 7/1996 Kirby et al.
5,533,311 A 7/1996 Tirrell et al.
5,562,154 A 10/1996 Benson et al.
5,586,680 A 12/1996 Dellby et al.
5,599,081 A 2/1997 Revlett et al.
5,600,966 A 2/1997 Valence et al.
5,632,543 A 5/1997 McGrath et al.
5,640,828 A 6/1997 Reeves et al.
5,643,485 A 7/1997 Potter et al.
5,652,039 A 7/1997 Tremain et al.
5,716,581 A 2/1998 Tirrell
5,768,837 A 6/1998 Sjoholm
5,792,801 A 8/1998 Tsuda et al.
5,813,454 A 9/1998 Potter
5,826,780 A 10/1998 Nesser et al.
5,827,385 A 10/1998 Meyer et al.
5,834,126 A 11/1998 Sheu
5,843,353 A 12/1998 De Vos et al.
5,866,228 A 2/1999 Awata
5,866,247 A 2/1999 Klatt et al.
5,868,890 A 2/1999 Fredrick
5,900,299 A 5/1999 Wynne
5,918,478 A 7/1999 Bostic et al.
5,924,295 A 7/1999 Park
5,950,395 A 9/1999 Takemasa et al.
5,952,404 A 9/1999 Simpson et al.
5,966,963 A 10/1999 Kovalaske
5,985,189 A 11/1999 Lynn et al.
6,013,700 A 1/2000 Asano et al.
6,063,471 A 5/2000 Dietrich et al.
6,094,922 A 8/2000 Ziegler
6,101,819 A 8/2000 Onaka et al.
6,109,712 A * 8/2000 Haworth ..... F24C 15/34 312/400
6,128,914 A 10/2000 Tamaoki et al.
6,132,837 A 10/2000 Boes et al.
6,158,233 A 12/2000 Cohen et al.

(56) References Cited

U.S. PATENT DOCUMENTS 6,163,976 A 12/2000 Tada et al.
6,164,030 A 12/2000 Dietrich
6,164,739 A 12/2000 Schultz et al.
6,187,256 B1 2/2001 Aslan et al.
6,209,342 B1 4/2001 Banicevic et al.
6,210,625 B1 4/2001 Matsushita et al.
6,220,473 B1 4/2001 Lehman et al.
6,221,456 B1 4/2001 Pogorski et al.
6,224,179 B1 5/2001 Wenning et al.
6,244,458 B1 6/2001 Frysinger et al.
6,260,377 B1 7/2001 Tamaoki et al.
6,266,970 B1 7/2001 Nam et al.
6,294,595 B1 9/2001 Tyagi et al.
6,305,768 B1 10/2001 Nishimoto
6,485,122 B2 1/2002 Wolf et al.
6,390,378 B1 5/2002 Briscoe, Jr. et al.
6,406,449 B1 6/2002 Moore et al.
6,408,841 B1 6/2002 Hirath et al.
6,415,623 B1 7/2002 Jennings et al.
6,428,130 B1 8/2002 Banicevic et al.
6,430,780 B1 8/2002 Kim et al.
6,460,955 B1 10/2002 Vaughan et al.
6,519,919 B1 2/2003 Takenouchi et al.
6,623,413 B1 9/2003 Wynne
6,629,429 B1 10/2003 Kawamura et al.
6,689,840 B1 2/2004 Eustace et al.
6,716,501 B2 4/2004 Kovalchuk et al.
6,736,472 B2 5/2004 Banicevic
6,749,780 B2 6/2004 Tobias
6,773,082 B2 8/2004 Lee
6,855,766 B2 2/2005 Oppenheimer-Stix et al.
6,858,280 B2 2/2005 Allen et al.
6,860,082 B1 3/2005 Yamamoto et al.
6,938,968 B2 9/2005 Tanimoto et al.
7,008,032 B2 3/2006 Chekal et al.
7,026,054 B2 4/2006 Ikegawa et al.
7,197,792 B2 4/2007 Moon
7,197,888 B2 4/2007 LeClear et al.
7,207,181 B2 4/2007 Murray et al.
7,210,308 B2 5/2007 Tanimoto et al.
7,234,247 B2 6/2007 Maguire
7,263,744 B2 9/2007 Kim et al.
7,284,390 B2 10/2007 Van Meter et al.
7,296,423 B2 11/2007 Müller et al.
7,316,125 B2 1/2008 Uekado et al.
7,343,757 B2 3/2008 Egan et al.
7,360,371 B2 4/2008 Feinauer et al.
7,449,227 B2 11/2008 Echigoya et al.
7,475,562 B2 1/2009 Jackovin
7,517,031 B2 4/2009 Laible
7,614,244 B2 11/2009 Venkatakrishnan et al.
7,625,622 B2 12/2009 Teckoe et al.
7,641,298 B2 1/2010 Hirath et al.
7,665,326 B2 2/2010 LeClear et al.
7,703,217 B2 4/2010 Tada et al.
7,703,824 B2 4/2010 Kittelson et al.
7,757,511 B2 7/2010 LeClear et al.
7,762,634 B2 7/2010 Tenra et al.
7,794,805 B2 9/2010 Aumaugher et al.
7,815,269 B2 10/2010 Wenning et al.
7,842,269 B2 11/2010 Schachtely et al.
7,845,745 B2 12/2010 Gorz et al.
7,861,538 B2 1/2011 Welle et al.
7,886,559 B2 2/2011 Hell et al.
7,893,123 B2 2/2011 Luisi
7,908,873 B1 3/2011 Cur et al.
7,930,892 B1 4/2011 Vonderhaar
7,938,148 B2 5/2011 Carlier et al.
7,992,257 B2 8/2011 Kim
8,049,518 B2 11/2011 Wern et al.
8,074,469 B2 12/2011 Hamel et al.
8,079,652 B2 12/2011 Laible et al.
8,083,985 B2 12/2011 Luisi et al.
8,108,972 B2 2/2012 Bae et al.
8,113,604 B2 2/2012 Olson et al.
8,117,865 B2 2/2012 Allard et al.
8,157,338 B2 4/2012 Seo et al.
8,162,415 B2 4/2012 Hagele et al.
8,163,080 B2 4/2012 Meyer et al.
8,176,746 B2 5/2012 Allard et al.
8,182,051 B2 5/2012 Laible et al.
8,197,019 B2 6/2012 Kim
8,202,599 B2 6/2012 Henn
8,211,523 B2 7/2012 Fujimori et al.
8,266,923 B2 9/2012 Bauer et al.
8,281,558 B2 10/2012 Hiemeyer et al.
8,299,656 B2 10/2012 Allard et al.
8,343,395 B2 1/2013 Hu et al.
8,353,177 B2 1/2013 Adamski et al.
8,382,219 B2 2/2013 Hottmann et al.
8,434,317 B2 5/2013 Besore
8,439,460 B2 5/2013 Laible et al.
8,456,040 B2 6/2013 Allard et al.
8,491,070 B2 7/2013 Davis et al.
8,516,845 B2 8/2013 Wuesthoff et al.
8,528,284 B2 9/2013 Aspenson et al.
8,590,992 B2 11/2013 Lim et al.
8,717,029 B2 5/2014 Chae et al.
8,739,568 B2 6/2014 Allard et al.
8,752,918 B2 6/2014 Kang
8,752,921 B2 6/2014 Gorz et al.
8,763,847 B2 7/2014 Mortarotti
8,764,133 B2 7/2014 Park et al.
8,770,682 B2 7/2014 Lee et al.
8,776,390 B2 7/2014 Hanaoka et al.
8,840,204 B2 9/2014 Bauer et al.
8,852,708 B2 10/2014 Kim et al.
8,871,323 B2 10/2014 Kim et al.
8,881,398 B2 11/2014 Hanley et al.
8,905,503 B2 12/2014 Sahasrabudhe et al.
8,943,770 B2 2/2015 Sanders et al.
8,944,541 B2 2/2015 Allard et al.
9,009,969 B2 4/2015 Choi et al.
RE45,501 E 5/2015 Maguire
9,056,952 B2 6/2015 Eilbracht et al.
9,074,811 B2 7/2015 Korkmaz
9,080,808 B2 7/2015 Choi et al.
9,102,076 B2 8/2015 Doshi et al.
9,103,482 B2 8/2015 Fujimori et al.
9,125,546 B2 9/2015 Kleemann et al.
9,140,480 B2 9/2015 Kuehl et al.
9,140,481 B2 9/2015 Curr et al.
9,170,045 B2 10/2015 Oh et al.
9,170,046 B2 10/2015 Jung et al.
9,188,382 B2 11/2015 Kim et al.
8,955,352 B2 12/2015 Lee et al.
9,221,210 B2 12/2015 Wu et al.
9,228,386 B2 1/2016 Thielmann et al.
9,267,727 B2 2/2016 Lim et al.
9,303,915 B2 4/2016 Kim et al.
9,328,951 B2 5/2016 Shin et al.
9,353,984 B2 5/2016 Kim et al.
9,410,732 B2 8/2016 Choi et al.
9,423,171 B2 8/2016 Betto et al.
9,429,356 B2 8/2016 Kim et al.
9,448,004 B2 9/2016 Kim et al.
9,463,917 B2 10/2016 Wu et al.
9,482,463 B2 11/2016 Choi et al.
9,506,689 B2 11/2016 Carbajal et al.
9,518,777 B2 12/2016 Lee et al.
9,568,238 B2 2/2017 Kim et al.
D781,641 S 3/2017 Incukur
D781,642 S 3/2017 Incukur
9,605,891 B2 3/2017 Lee et al.
9,696,085 B2 7/2017 Seo et al.
9,702,621 B2 7/2017 Cho et al.
9,759,479 B2 9/2017 Ramm et al.
9,777,958 B2 10/2017 Choi et al.
9,791,204 B2 10/2017 Kim et al.
9,791,205 B2 * 10/2017 Mukherjee ..... F25D 23/066
9,833,942 B2 12/2017 Wu et al.
9,976,798 B2 * 5/2018 Mukherjee ..... F25D 23/066
2002/0004111 A1 1/2002 Matsubara et al.
2002/0114937 A1 8/2002 Albert et al.

(56) References Cited

U.S. PATENT DOCUMENTS

2002/0144482 A1 10/2002 Henson et al.
2002/0168496 A1 11/2002 Morimoto et al.
2003/0008100 A1 1/2003 Horn
2003/0041612 A1 3/2003 Piloni et al.
2003/0056334 A1 3/2003 Finkelstein
2003/0157284 A1 8/2003 Tanimoto et al.
2003/0167789 A1 9/2003 Tanimoto et al.
2003/0173883 A1 9/2003 Koons
2004/0144130 A1 7/2004 Jung
2004/0178707 A1 9/2004 Avendano et al.
2004/0180176 A1 9/2004 Rusek
2004/0226141 A1 11/2004 Yates et al.
2004/0253406 A1 12/2004 Hayashi et al.
2005/0042247 A1 2/2005 Gomoll et al.
2005/0229614 A1 10/2005 Ansted
2005/0235682 A1 10/2005 Hirai et al.
2006/0064846 A1 3/2006 Espendola et al.
2006/0076863 A1 4/2006 Echigoya et al.
2006/0201189 A1 9/2006 Adamski et al.
2006/0261718 A1 11/2006 Miseki et al.
2006/0263571 A1 11/2006 Tsunetsugu et al.
2006/0266075 A1 11/2006 Itsuki et al.
2007/0001563 A1 1/2007 Park et al.
2007/0099502 A1 5/2007 Ferinauer et al.
2007/0176526 A1 8/2007 Gomoll et al.
2007/0266654 A1 11/2007 Noale
2008/0044488 A1 2/2008 Zimmer et al.
2008/0048540 A1 2/2008 Kim
2008/0138458 A1 6/2008 Ozasa et al.
2008/0196441 A1 8/2008 Ferreira
2008/0300356 A1 12/2008 Meyer et al.
2008/0309210 A1 12/2008 Luisi et al.
2009/0032541 A1 2/2009 Rogala et al.
2009/0056367 A1 3/2009 Nuemann
2009/0058244 A1 3/2009 Cho et al.
2009/0113925 A1 5/2009 Korkmaz
2009/0131571 A1 5/2009 Fraser et al.
2009/0179541 A1 7/2009 Smith et al.
2009/0205357 A1 8/2009 Lim et al.
2009/0302728 A1 12/2009 Rotter et al.
2009/0322470 A1 12/2009 Yoo et al.
2009/0324871 A1 12/2009 Henn
2010/0170279 A1 7/2010 Aoki
2010/0206464 A1 8/2010 Heo et al.
2010/0218543 A1 9/2010 Duchame
2010/0231109 A1 9/2010 Matzke et al.
2010/0287843 A1 11/2010 Oh
2010/0287974 A1 11/2010 Cur et al.
2010/0293984 A1 11/2010 Adamski et al.
2010/0295435 A1 11/2010 Kendall et al.
2011/0011119 A1 1/2011 Kuehl et al.
2011/0023527 A1 2/2011 Kwon et al.
2011/0030894 A1 2/2011 Tenra et al.
2011/0095669 A1 4/2011 Moon et al.
2011/0146325 A1 6/2011 Lee
2011/0146335 A1 6/2011 Jung et al.
2011/0165367 A1 7/2011 Kojima et al.
2011/0215694 A1 9/2011 Fink et al.
2011/0220662 A1 9/2011 Kim et al.
2011/0241513 A1 10/2011 Nomura et al.
2011/0241514 A1 10/2011 Nomura et al.
2011/0260351 A1 10/2011 Corradi et al.
2011/0290808 A1 12/2011 Bai et al.
2011/0309732 A1 12/2011 Horii et al.
2011/0315693 A1 12/2011 Cur et al.
2012/0000234 A1 1/2012 Adamski et al.
2012/0011879 A1 1/2012 Gu
2012/0060544 A1 3/2012 Lee et al.
2012/0099255 A1 4/2012 Lee et al.
2012/0103006 A1 5/2012 Jung et al.
2012/0104923 A1 5/2012 Jung et al.
2012/0118002 A1 5/2012 Kim et al.
2012/0137501 A1 6/2012 Allard et al.
2012/0152151 A1 6/2012 Meyer et al.
2012/0196059 A1 8/2012 Fujimori et al.
2012/0231204 A1 9/2012 Jeon et al.
2012/0237715 A1 9/2012 McCraken
2012/0240612 A1 9/2012 Wusthoff et al.
2012/0273111 A1 11/2012 Nomura et al.
2012/0279247 A1 11/2012 Katu et al.
2012/0280608 A1 11/2012 Park et al.
2012/0285971 A1 11/2012 Junge et al.
2012/0297813 A1 11/2012 Hanley et al.
2012/0324937 A1 12/2012 Adamski et al.
2013/0026900 A1 1/2013 Oh et al.
2013/0033163 A1 2/2013 Kang
2013/0043780 A1 2/2013 Ootsuka et al.
2013/0068990 A1 3/2013 Eilbracht et al.
2013/0111941 A1 5/2013 Yu et al.
2013/0221819 A1 8/2013 Wing
2013/0255304 A1 10/2013 Cur et al.
2013/0256318 A1 10/2013 Kuehl et al.
2013/0256319 A1 10/2013 Kuehl et al.
2013/0257256 A1 10/2013 Allard et al.
2013/0257257 A1 10/2013 Cur et al.
2013/0264439 A1 10/2013 Allard et al.
2013/0270732 A1 10/2013 Wu et al.
2013/0285527 A1 10/2013 Choi et al.
2013/0293080 A1 11/2013 Kim et al.
2013/0305535 A1 11/2013 Cur et al.
2013/0328472 A1 12/2013 Shim et al.
2014/0009055 A1 1/2014 Cho et al.
2014/0097733 A1 4/2014 Seo et al.
2014/0132144 A1 5/2014 Kim et al.
2014/0166926 A1 6/2014 Lee et al.
2014/0171578 A1 6/2014 Meyer et al.
2014/0190978 A1 7/2014 Bowman et al.
2014/0196305 A1 7/2014 Smith
2014/0216706 A1 8/2014 Melton et al.
2014/0232250 A1 8/2014 Kim et al.
2014/0260332 A1 9/2014 Wu
2014/0346942 A1 11/2014 Kim et al.
2014/0364527 A1 12/2014 Wintermantel et al.
2015/0011668 A1 1/2015 Kolb et al.
2015/0015133 A1 1/2015 Carbajal et al.
2015/0017386 A1 1/2015 Kolb et al.
2015/0027628 A1 1/2015 Cravens et al.
2015/0059399 A1 3/2015 Hwang et al.
2015/0115790 A1 4/2015 Ogg
2015/0147514 A1 5/2015 Shinohara et al.
2015/0159936 A1 6/2015 Oh et al.
2015/0168050 A1 6/2015 Cur et al.
2015/0176888 A1 6/2015 Cur et al.
2015/0184923 A1 7/2015 Jeon
2015/0190840 A1 7/2015 Muto et al.
2015/0224685 A1 8/2015 Amstutz
2015/0241115 A1 8/2015 Strauss et al.
2015/0241118 A1 8/2015 Wu
2015/0285551 A1 10/2015 Aiken et al.
2016/0084567 A1 3/2016 Fernandez et al.
2016/0116100 A1 4/2016 Thiery et al.
2016/0123055 A1 5/2016 Ueyama
2016/0161175 A1 6/2016 Benold et al.
2016/0178267 A1 6/2016 Hao et al.
2016/0178269 A1 6/2016 Hiemeyer et al.
2016/0235201 A1 8/2016 Soot
2016/0240839 A1 8/2016 Umeyama et al.
2016/0258671 A1 9/2016 Allard et al.
2016/0290702 A1 10/2016 Sexton et al.
2016/0348957 A1 12/2016 Hitzelberger et al.
2017/0038126 A1 2/2017 Lee et al.
2017/0157809 A1 6/2017 Deka et al.
2017/0167781 A1* 6/2017 Mukherjee ..... F25D 23/066
2017/0167782 A1* 6/2017 Diptesh ..... F25D 23/066
2017/0176086 A1 6/2017 Kang
2017/0184339 A1 6/2017 Liu et al.
2017/0190081 A1* 7/2017 Naik ..... B29C 44/56
2017/0191746 A1 7/2017 Seo
2018/0031306 A1* 2/2018 Mukherjee ..... F25D 23/066

FOREIGN PATENT DOCUMENTS

CA 2259665 1/1998
CA 2640006 8/2007

(56) References Cited

FOREIGN PATENT DOCUMENTS

| | | | |
|---|---|---|---|
| CN | 1158509 | | 9/1997 |
| CN | 1970185 | | 5/2007 |
| CN | 100359272 | | 1/2008 |
| CN | 101437756 | | 5/2009 |
| CN | 201680116 | | 12/2010 |
| CN | 201748744 | U | 2/2011 |
| CN | 102296714 | | 12/2011 |
| CN | 102452522 | | 5/2012 |
| CN | 102717578 | A | 10/2012 |
| CN | 102720277 | | 10/2012 |
| CN | 103072321 | | 5/2013 |
| CN | 202973713 | U | 6/2013 |
| CN | 203331442 | | 12/2013 |
| CN | 104816478 | A | 8/2015 |
| CN | 105115221 | | 12/2015 |
| CN | 204963379 | U | 1/2016 |
| DE | 1150190 | | 6/1963 |
| DE | 4110292 | A1 | 10/1992 |
| DE | 4409091 | | 9/1995 |
| DE | 19818890 | | 11/1999 |
| DE | 19914105 | | 9/2000 |
| DE | 19915311 | | 10/2000 |
| DE | 102008026528 | | 12/2009 |
| DE | 102009046810 | | 5/2011 |
| DE | 102010024951 | | 12/2011 |
| DE | 102011051178 | A1 | 12/2012 |
| DE | 102012223536 | | 6/2014 |
| DE | 102012223541 | | 6/2014 |
| EP | 0480451 | | 4/1992 |
| EP | 0645576 | A1 | 3/1995 |
| EP | 0691518 | | 1/1996 |
| EP | 0260699 | | 3/1998 |
| EP | 0860669 | | 8/1998 |
| EP | 1087186 | | 3/2001 |
| EP | 1200785 | | 5/2002 |
| EP | 1243880 | | 9/2002 |
| EP | 1484563 | | 12/2004 |
| EP | 1496322 | | 1/2005 |
| EP | 1505359 | | 2/2005 |
| EP | 1602425 | A1 | 12/2005 |
| EP | 1624263 | A2 | 8/2006 |
| EP | 2342511 | | 7/2011 |
| EP | 2543942 | A2 | 1/2013 |
| EP | 2607073 | | 6/2013 |
| EP | 2789951 | | 10/2014 |
| EP | 2878427 | A1 | 6/2015 |
| FR | 2980963 | | 4/2013 |
| FR | 2991698 | A1 | 12/2013 |
| GB | 837929 | | 6/1960 |
| GB | 1214548 | | 12/1970 |
| JP | S4828353 | | 8/1973 |
| JP | S5157777 | | 5/1976 |
| JP | S59191588 | | 12/1984 |
| JP | 403013779 | | 1/1991 |
| JP | 404165197 | | 6/1992 |
| JP | 04165197 | | 10/1992 |
| JP | 04309778 | A | 11/1992 |
| JP | H06159922 | | 6/1994 |
| JP | H071479 | | 1/1995 |
| JP | H07167377 | | 7/1995 |
| JP | H08300052 | | 11/1996 |
| JP | H08303686 | | 11/1996 |
| JP | H09166271 | | 6/1997 |
| JP | H10113983 | | 5/1998 |
| JP | 11159693 | A | 6/1999 |
| JP | H11311395 | | 11/1999 |
| JP | H11336990 | | 12/1999 |
| JP | 2000097390 | | 4/2000 |
| JP | 20000117334 | | 4/2000 |
| JP | 2000320958 | A | 11/2000 |
| JP | 2001038188 | | 2/2001 |
| JP | 2001116437 | | 4/2001 |
| JP | 2001336691 | | 12/2001 |
| JP | 2001343176 | | 12/2001 |
| JP | 2002068853 | | 3/2002 |
| JP | 3438948 | | 8/2003 |
| JP | 3478771 | | 12/2003 |
| JP | 2004303695 | | 10/2004 |
| JP | 2005069596 | A | 3/2005 |
| JP | 2005098637 | A | 4/2005 |
| JP | 2005114015 | | 4/2005 |
| JP | 2005164193 | | 6/2005 |
| JP | 2005256849 | | 9/2005 |
| JP | 2006-///92 | | 3/2006 |
| JP | 2006161834 | A | 6/2006 |
| JP | 2006161945 | | 6/2006 |
| JP | 3792801 | | 7/2006 |
| JP | 2006200685 | A | 8/2006 |
| JP | 2007263186 | | 10/2007 |
| JP | 4111096 | | 7/2008 |
| JP | 2008157431 | | 7/2008 |
| JP | 2008190815 | | 8/2008 |
| JP | 2009063064 | | 3/2009 |
| JP | 2009162402 | | 7/2009 |
| JP | 2009524570 | | 7/2009 |
| JP | 2010017437 | | 1/2010 |
| JP | 2010071565 | | 4/2010 |
| JP | 2010108199 | | 5/2010 |
| JP | 2010145002 | | 7/2010 |
| JP | 4545126 | | 9/2010 |
| JP | 2010236770 | | 10/2010 |
| JP | 2010276309 | | 12/2010 |
| JP | 2011002033 | | 1/2011 |
| JP | 2011069612 | | 4/2011 |
| JP | 4779684 | | 9/2011 |
| JP | 2011196644 | | 10/2011 |
| JP | 2012026493 | | 2/2012 |
| JP | 4897473 | | 3/2012 |
| JP | 2012063029 | | 3/2012 |
| JP | 2012087993 | | 5/2012 |
| JP | 2012163258 | | 8/2012 |
| JP | 2012189114 | | 10/2012 |
| JP | 2012242075 | | 12/2012 |
| JP | 2013002484 | | 1/2013 |
| JP | 2013050242 | | 3/2013 |
| JP | 2013050267 | A | 3/2013 |
| JP | 2013076471 | A | 4/2013 |
| JP | 2013088036 | | 5/2013 |
| JP | 2013195009 | | 9/2013 |
| KR | 20010068977 | A | 7/2001 |
| KR | 20020057547 | | 7/2002 |
| KR | 20020080938 | | 10/2002 |
| KR | 20030083812 | | 11/2003 |
| KR | 20040000126 | | 1/2004 |
| KR | 20050095357 | A | 9/2005 |
| KR | 100620025 | B1 | 9/2006 |
| KR | 20070044024 | | 4/2007 |
| KR | 1020070065743 | A | 6/2007 |
| KR | 20080103845 | | 11/2008 |
| KR | 20090026045 | | 3/2009 |
| KR | 101017776 | | 2/2011 |
| KR | 20120007241 | | 1/2012 |
| KR | 20120046621 | | 5/2012 |
| KR | 20120051305 | | 5/2012 |
| KR | 20120055052 | A | 5/2012 |
| KR | 20150089495 | A | 8/2015 |
| RU | 2061925 | C1 | 6/1996 |
| RU | 2077411 | C1 | 4/1997 |
| RU | 2081858 | | 6/1997 |
| RU | 2132522 02 | | 6/1999 |
| RU | 2162576 02 | | 1/2001 |
| RU | 2162576 | C2 | 1/2001 |
| RU | 2166158 | C1 | 4/2001 |
| RU | 2187433 02 | | 8/2002 |
| RU | 2234645 | C1 | 8/2004 |
| RU | 2234645 | C2 | 8/2004 |
| RU | 2252377 | | 5/2005 |
| RU | 2253792 02 | | 6/2005 |
| RU | 2349618 02 | | 3/2009 |
| RU | 2414288 02 | | 3/2011 |
| RU | 2422598 | | 6/2011 |
| RU | 142892 | | 7/2014 |
| RU | 2529525 | C1 | 9/2014 |
| RU | 2571031 | | 12/2015 |

(56) References Cited

FOREIGN PATENT DOCUMENTS

| | | | |
|---|---|---|---|
| SU | 203707 | | 12/1967 |
| SU | 00476407 | A1 | 7/1975 |
| SU | 547614 | | 5/1977 |
| SU | 648780 | A1 | 2/1979 |
| SU | 01307186 | A1 | 4/1987 |
| WO | 9614207 | A1 | 5/1996 |
| WO | 9721767 | | 6/1997 |
| WO | 098049506 | | 11/1998 |
| WO | 9920961 | A1 | 4/1999 |
| WO | 9920964 | | 4/1999 |
| WO | 200160598 | | 8/2001 |
| WO | 200202987 | | 1/2002 |
| WO | 2002052208 | | 4/2002 |
| WO | 02060576 | A1 | 8/2002 |
| WO | 03072684 | A1 | 9/2003 |
| WO | 2003089729 | | 10/2003 |
| WO | 2004010042 | A1 | 1/2004 |
| WO | 2006045694 | | 5/2006 |
| WO | 2006073540 | A2 | 7/2006 |
| WO | 2007033836 | A1 | 3/2007 |
| WO | 2007085511 | | 8/2007 |
| WO | 2007106067 | A2 | 9/2007 |
| WO | 2008065453 | | 6/2008 |
| WO | 2008077741 | | 7/2008 |
| WO | 2008118536 | A2 | 10/2008 |
| WO | 2008122483 | A2 | 10/2008 |
| WO | 2009013106 | A2 | 1/2009 |
| WO | 2009112433 | A1 | 9/2009 |
| WO | 2009147106 | | 12/2009 |
| WO | 2010007783 | A1 | 1/2010 |
| WO | 2010029730 | | 3/2010 |
| WO | 2010043009 | | 4/2010 |
| WO | 2010092627 | | 8/2010 |
| WO | 2010127947 | | 11/2010 |
| WO | 2010127947 | A2 | 11/2010 |
| WO | 2011003711 | | 1/2011 |
| WO | 2011058678 | | 5/2011 |
| WO | 2011058678 | A1 | 5/2011 |
| WO | 2011081498 | | 7/2011 |
| WO | 2012023705 | | 2/2012 |
| WO | 2012026715 | | 3/2012 |
| WO | 2012031885 | | 3/2012 |
| WO | 2012043990 | | 4/2012 |
| WO | 2012044001 | | 4/2012 |
| WO | 2012085212 | | 6/2012 |
| WO | 2012119892 | | 9/2012 |
| WO | 2012152646 | | 11/2012 |
| WO | 2013116103 | | 8/2013 |
| WO | 2013116302 | | 8/2013 |
| WO | 2014038150 | | 3/2014 |
| WO | 2014038150 | A1 | 3/2014 |
| WO | 2014095542 | | 6/2014 |
| WO | 2014121893 | A1 | 8/2014 |
| WO | 2014184393 | | 11/2014 |
| WO | 2014184393 | A1 | 11/2014 |
| WO | 2013140816 | A1 | 8/2015 |
| WO | 2016082907 | A1 | 6/2016 |
| WO | 2017029782 | A1 | 2/2017 |

OTHER PUBLICATIONS

Raszewski et al., "Methods For Producing Hollow Glass Microspheres," Powerpoint, cached from Google, Jul. 2009, 6 pages.

* cited by examiner

MACHINE COMPARTMENT FOR A VACUUM INSULATED STRUCTURE

CROSS-REFERENCE TO RELATED APPLICATION

This application claims priority to International Application No. PCT/US/2016/047558, filed on Aug. 18, 2016, entitled "MACHINE COMPARTMENT FOR A VACUUM INSULATED STRUCTURE," the disclosure of which is hereby incorporated herein by reference in its entirety.

BACKGROUND

The efficiency of a refrigerator may, at least in part, rely on the refrigerator's ability to keep items within the refrigerator cool and prevent heat from entering the refrigerator. The formation of compartments within the refrigerator may affect the refrigerator's insulative ability. Accordingly, new methods of compartment formation within refrigerators are sought.

BRIEF SUMMARY OF THE DISCLOSURE

According to one aspect of the present disclosure, a refrigerator cabinet is provided that includes an inner liner and an external wrapper. The inner liner is positioned within the external wrapper such that a gap is defined between the external wrapper and inner liner. The external wrapper includes a machine compartment comprising: a top wall, an interior wall, a bottom wall, a first side wall and a second side wall. A foot is defined by the external wrapper and is positioned below the machine compartment. The foot is at least partially defined by the bottom wall and at least partially supports the refrigerator cabinet.

According to another aspect of the present disclosure, a method of forming a refrigerator cabinet is provided and includes the steps of providing an external wrapper defining a rear surface; deep-drawing the rear surface of the external wrapper to form a machine compartment defining a top wall, a bottom wall and an interior wall; positioning an inner liner within the external wrapper such that a gap is defined between the inner liner and the inner wall of the machine compartment; and drawing a vacuum within the gap.

According to yet another aspect of the present disclosure, a method of forming a vacuum insulated structure is provided that includes the steps of providing an external wrapper; deep-drawing the external wrapper to form a machine compartment and a foot, the foot configured to at least partially support the vacuum insulated structure; positioning an inner liner within the external wrapper such that a gap is defined between the inner liner and the external wrapper; and drawing a vacuum within the gap.

These and other features, advantages, and objects of the present disclosure will be further understood and appreciated by those skilled in the art by reference to the following specification, claims, and appended drawings.

BRIEF DESCRIPTION OF THE DRAWINGS

The foregoing summary, as well as the following detailed description of the disclosure, will be better understood when read in conjunction with the appended drawings. For the purpose of illustrating the disclosure, there are shown in the drawings, certain embodiment(s). It should be understood, however, that the disclosure is not limited to the precise arrangements and instrumentalities shown. Drawings are not necessarily to scale. Certain features of the disclosure may be exaggerated in scale or shown in schematic form in the interest of clarity and conciseness.

DETAILED DESCRIPTION

Figure 1A:
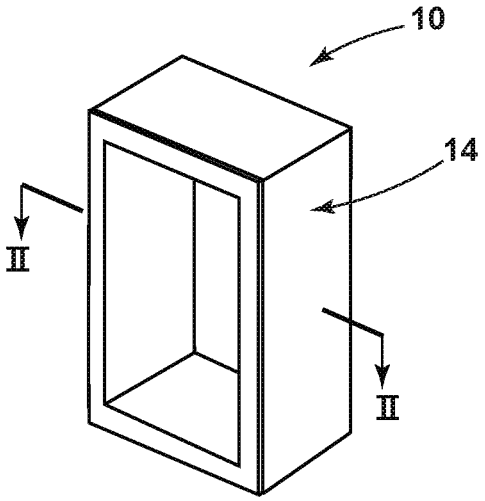
FIG. 1A is a top perspective view of a refrigerator cabinet, according to one example.

Additional features and advantages of the invention will be set forth in the detailed description that follows and will be apparent to those skilled in the art from the description, or recognized by practicing the invention as described in the following description together with the claims and appended drawings.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Referring to FIGS. 1A-4, a vacuum insulated structure (e.g., depicted as a refrigerator 10) includes a cabinet 14 having an inner liner 18 and an external wrapper 22. The inner liner 18 is positioned within the external wrapper 22 such that a gap 26 is defined between the external wrapper 22 and inner liner 18. The external wrapper 22 integrally defines a machine compartment 30. The machine compartment 30 includes a top wall 34, an interior wall 38, a bottom wall 42, a first side wall 46 and a second side wall 50. A foot 54 is defined by the external wrapper 22 and is positioned below the machine compartment 30. The foot 54 is at least partially defined by the bottom wall 42 and at least partially supports the refrigerator cabinet 14.

Figure 1B:
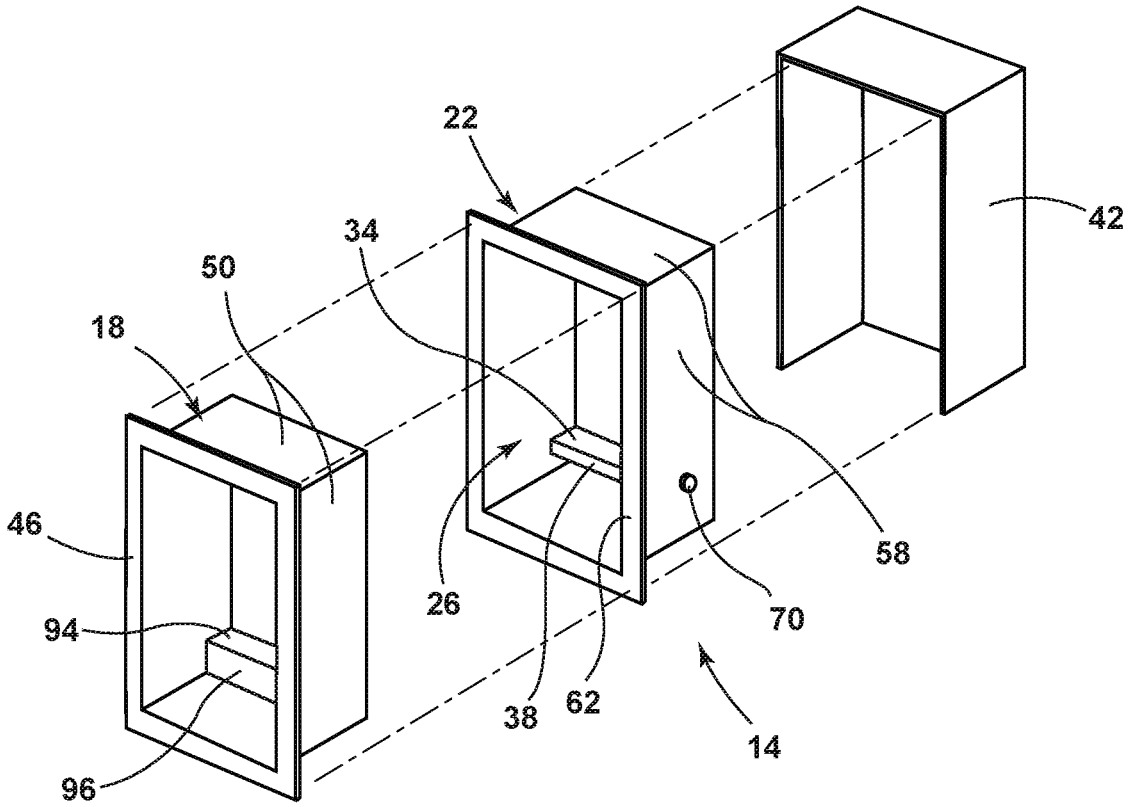
FIG. 1B is an exploded top view perspective of the refrigerator cabinet of FIG. 1A, according to one example.

Referring now to FIGS. 1A and 1B, the refrigerator 10 includes the cabinet 14. The refrigerator 10 may take a variety of configurations including French door, side-by-side, top freezer, bottom freezer, counter depth, compact, built-in, and other types of refrigerators. The cabinet 14 includes the inner liner 18, the external wrapper 22 and may optionally include a shell 42. In the depicted example, the inner liner 18 has a generally rectangular box shape, but may take a variety of shapes including a cube, prism, parallelepiped, etc. and combinations thereof. The inner liner 18 may have a liner flange 48 disposed around the inner liner 18 which is connected to a plurality of liner walls 52 which define the inner liner 18. The inner liner 18 may be formed from a polymeric material having high barrier properties (e.g., low gas permeation), metals and combinations thereof. The inner liner 18 may be formed via thermoforming, injection molding, bending and/or forming. The liner walls 52 of the inner liner 18 may have a thickness ranging from between about 0.1 mm to about 2.0 mm. In a specific example, the liner walls 52 have a thickness of about 0.5 mm.

The inner liner 18 is shaped and configured to mate, couple or otherwise be positioned within the external wrapper 22. The external wrapper 22 includes a plurality of wrapper walls 58 to which a wrapper flange 62 is coupled. The wrapper flange 62 and the liner flange 48 are configured to be coupled when the cabinet 14 is in an assembled configuration. The coupling of the liner flange 48 and the wrapper flange 62 may be performed such that an airtight, or hermetic, seal is formed between the inner liner 18 and the external wrapper 22. The hermetic seal of the wrapper flange 62 and the liner flange 48 may be achieved through use of adhesives, welding, and elastomeric gasket fitting under compression and/or crimping.

The external wrapper 22 may be formed of and by any of the materials and processes listed above in connection with the inner liner 18. The wrapper walls 58 of the external wrapper 22 may have a thickness ranging from between about 0.1 mm to about 1.0 mm. In a specific example, the wrapper walls 58 have a thickness of about 0.5 mm. The wrapper walls 58 of the external wrapper 22 may define a vacuum port 70. The vacuum port 70 may be positioned as illustrated or in a variety of positions about the external wrapper 22. It will be understood that the vacuum port 70 may be disposed on either the external wrapper 22 or inner liner 18. Further, more than one vacuum port 70 may be defined on either or both of the inner liner 18 and external wrapper 22. The vacuum port 70 may be used to access (e.g., draw a vacuum and/or perform maintenance within) the gap 26 once the inner liner 18 and the external wrapper 22 are bonded. The vacuum port 70 may have a diameter of between about 10 mm and about 50 mm, or between about 12.5 mm and about 25 mm. In examples utilizing more than one vacuum port 70, the sizes of the vacuum ports 70 may vary.

Once the inner liner 18 and the external wrapper 22 have been joined and the gap 26 defined, the gap 26 may have a thickness of between about 12 mm to about 60 mm. The thickness of the gap 26 may vary throughout the refrigerator 10 or may remain constant. The gap 26 may have an air pressure of less than about 1 atm (101,325 Pa), less than about 0.5 atm (50,662.5 Pa), less than about 0.1 atm (10,132.5 Pa), less than about 0.00986 atm (1000 pa), less than about 0.001 atm (101.325 Pa), or less than about 0.00001 atm (1.01 Pa). According to some examples, the gap 26 may be partially or fully filled with an insulator. The insulator may be a material configured to have low thermal conductivity. For example, the insulator may include precipitated silica, polyurethane foam, fumed silica, beads (e.g., of glass, ceramic, and/or an insulative polymer), hollow organic micro/nanospheres, hollow inorganic micro/nanospheres, silica aerogel, nano aerogel powder, perlite, glass fibers, polyisocyanurate, urea foam, rice hulls, rice husk ash, diatomaceous earth, cenospheres, polyethylene foam, vermiculite, fiberglass and combinations thereof. Optionally, an opacifier (e.g., $TiO_2$, SiC and/or carbon black) may be included in the insulator or materials configured to change and/or reduce the radiation conduction, the flow properties and/or packing factor of the insulator. Further, one or more gas (e.g., oxygen, hydrogen, carbon dioxide) and/or moisture getters may be included in the insulator.

Figure 2:
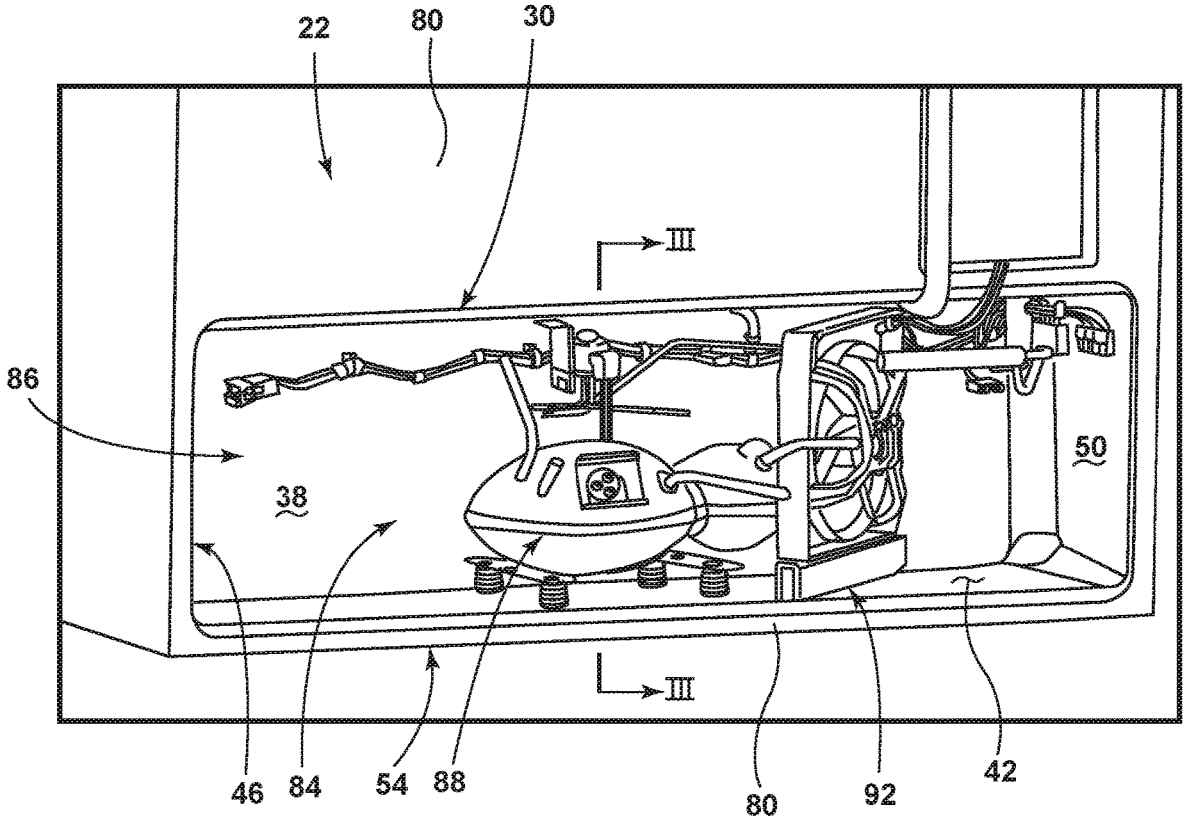
FIG. 2 is a rear view perspective of the refrigerator cabinet with an exposed machine compartment, according to one example.
Figure 3:
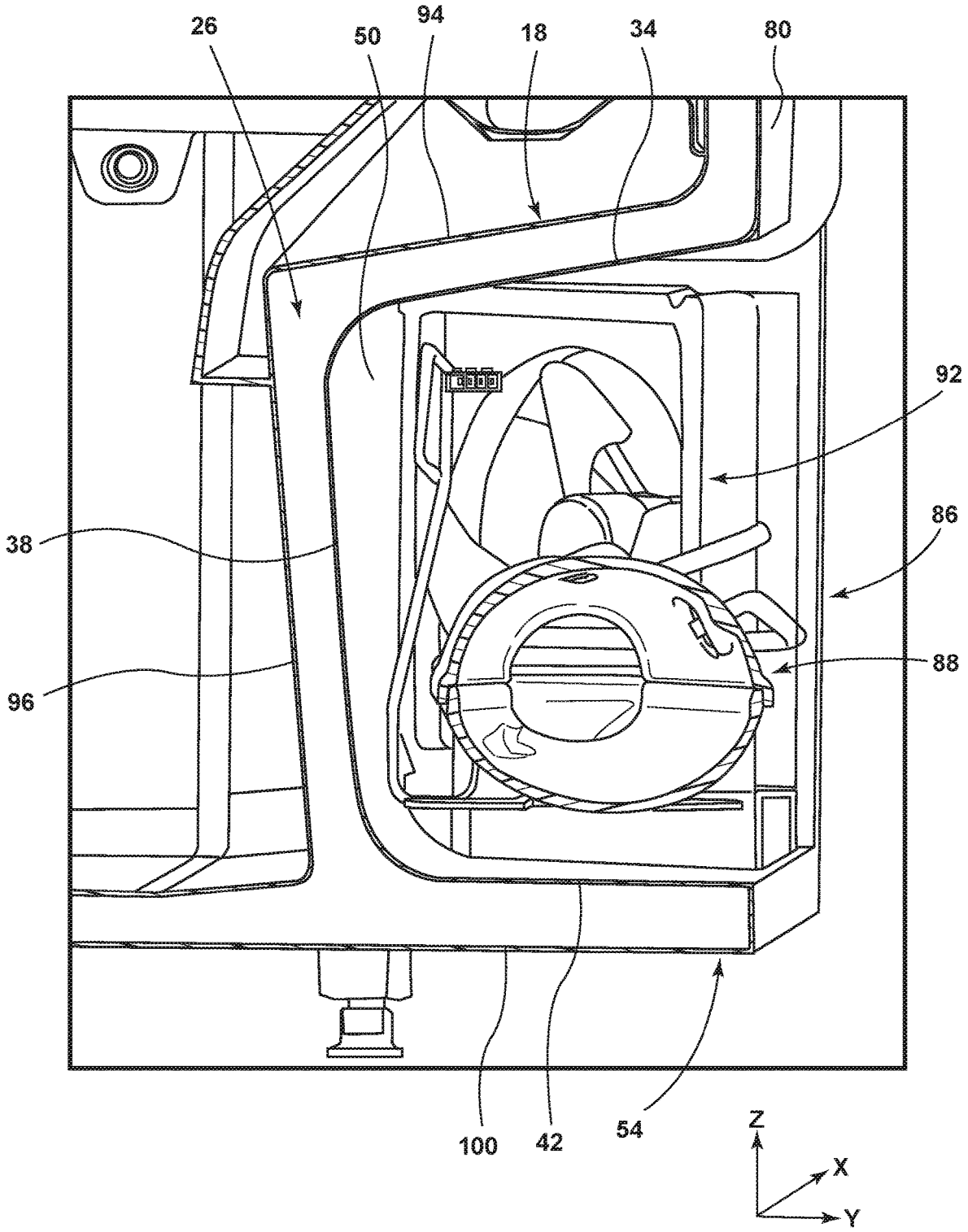
FIG. 3 is a cross-sectional view taken at line III of FIG. 2.
Figure 4:
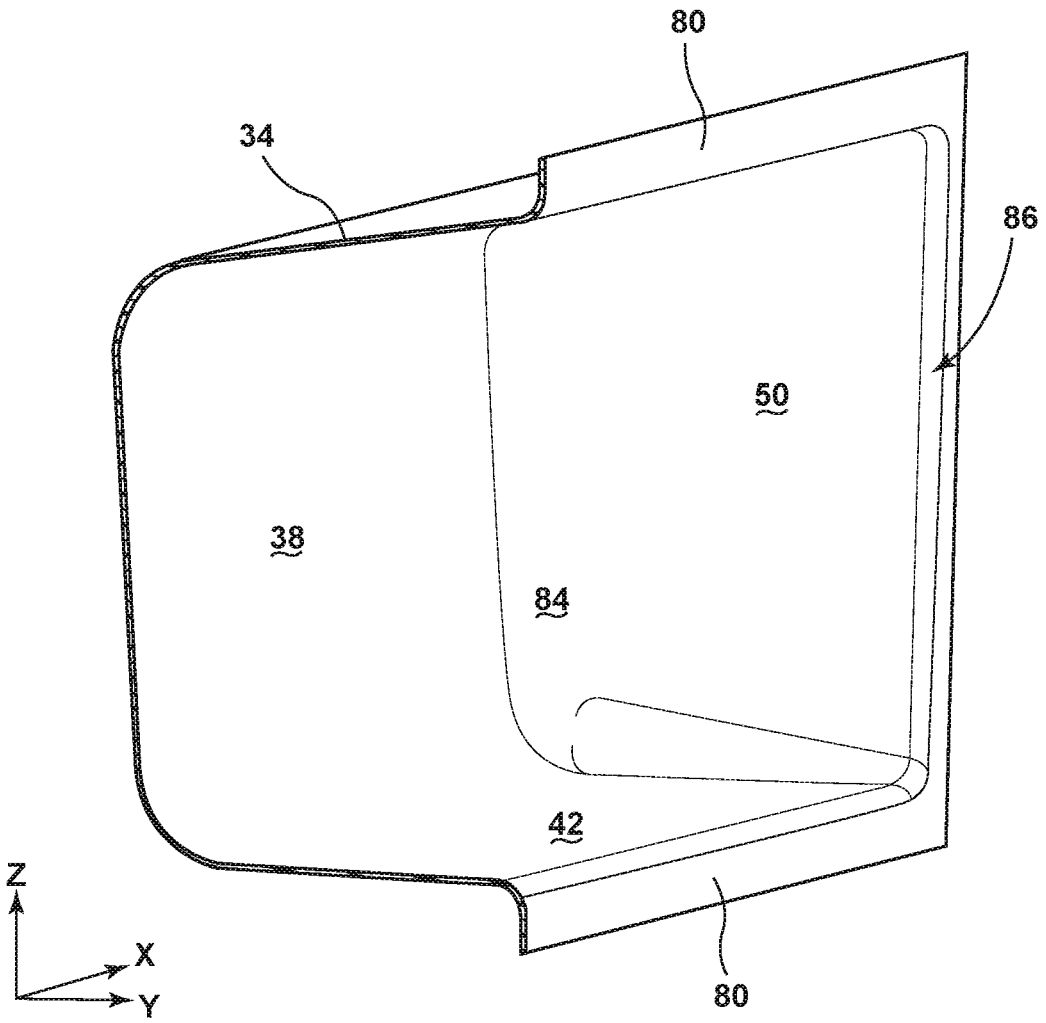
FIG. 4 is a cross-sectional perspective view of a machine compartment of the refrigerator cabinet taken at line III of FIG. 2.

Referring now to FIGS. 2-4, a rear surface 80 of the external wrapper 22 defines the machine compartment 30. As explained above, the machine compartment 30 includes the top wall 34, the interior wall 38, the bottom wall 42, the first side wall 46 and the second side wall 50. The walls 34, 38, 42, 46, 50 cooperate to define a compartment space 84 and a compartment opening 86 permitting access to the compartment space 84. The walls 34, 38, 42, 46, 50 each include a planar extent. According to some examples, the compartment opening 86 may be covered with a shroud during operation. The compartment space 84 of the machine compartment 30 is a space configured to hold various mechanical and electrical components of the refrigerator 10. In the depicted example, positioned within the compartment space 84 are a compressor 88 and a fan 92. It will be understood that more or less components (e.g., circuit boards, tubes, hoses, wires, condensers, valves) may be positioned within the compartment space 84. The machine compartment 30 extends inboard (i.e., into the refrigerator 10) relative to the rear surface 80.

The machine compartment 30 is integrally defined by the external wrapper 22. As such, according to various examples, the machine compartment 30 includes no welds or other joints between the top wall 34, the interior wall 38, the bottom wall 42, the first side wall 46 and the second side wall 50. The machine compartment 30 may be formed using a variety of techniques. According to one example, the machine compartment 30 may be formed via a deep-drawing technique. In such a deep-drawing technique, the external wrapper 22 is radially drawn into a forming die by the mechanical action of a punch. The deep drawing process may result in a machine compartment 30 which has a depth (i.e., inboard direction) greater than its diameter. During the deep-drawing process, the external wrapper 22 may be redrawn through a series of dies to achieve a desired shape for the machine compartment 30. Deep-drawing may result in the machine compartment 30 being inboard of the rear surface 80. It will be understood that other forming techniques capable of forming the machine compartment 30 integrally from the external wrapper 22 may also be used without departing from the teachings provided herein.

The top wall 34, the interior wall 38, the bottom wall 42, the first side wall 46 and the second side wall 50 may each be sized and angled (with respect to the rear surface 80) differently than one another (i.e., not parallel). In other words, the angle and size of the planar extent of each of the walls 34, 38, 42, 46, and 50 may be different. For example, the top wall 34 and bottom walls 42 may be angled toward a Z-axis direction off of an X-Y plane, the first and second side walls 46, 50 may be angled in an X-axis direction off of a Y-Z plane, and the interior wall 38 may be angled in a Y-axis direction off of an X-Z plane. The walls 34, 38, 42, 46, 50 may each be angled in their respective directions by between about 0° and about 10°, or between about 0.5° and about 5°. In a specific example, the interior wall 38 may be angled in an inboard Y-axis direction such that a top portion of the machine compartment 30 is volumetrically larger than a bottom portion (i.e., the top wall 34 has a greater depth in the gap 26 than the bottom wall 42).

Integral formation of the machine compartment 30 from the rear surface 80 of the external wrapper 22 results in a plurality of interfaces between the walls 34, 38, 42, 46, 50 themselves as well as the top, bottom, first and second side walls 34, 42, 46, 50 and the rear surface 80. According to various examples, the interfaces may be curved (i.e., have a radius of curvature) or be substantially 90° angles. The top wall 34 to rear surface 80 interface may have a radius of curvature of between about 0 mm and about 15 mm. The top wall 34 to interior wall 38 interface may have a radius of curvature of between about 0 mm and about 40 mm. The radius of curvature of an interface between the bottom wall 42 and the second side wall 50 may vary. Proximate the compartment opening 86, the radius of curvature may be between about 0 mm to about 10 mm, while proximate the interior wall 38 the radius of curvature may be between about 0 mm and about 40 mm.

The inner liner 18 (FIG. 3) is formed such that the gap 26 extends around the machine compartment 30. The inner liner 18 is in a spaced apart configuration from the top wall 34, the interior wall 38, and the first and second side walls 46, 50. In the depicted example, the inner liner 18 integrally defines an upper wall 94 and an inboard wall 96. The upper wall 94 is positioned above the top wall 34 of the machine compartment 30. The inboard wall 96 is positioned inboard of the interior wall 38. The upper wall 94 and the inboard wall 96 may or may not have substantially the same angling as the respective top wall 34 and interior wall 38. In examples where the upper wall 94 and the inboard wall 96 share the same angling as the top wall 34 and the interior wall 38, the width of the gap 26 may be uniform around the machine compartment 30. It will be understood that the upper wall 94 and the inboard wall 96 may not share the same angling or shape as the top wall 34 and the interior wall 38 such that the width of the gap 26 is not uniform. The upper wall 94 and the inboard wall 96 may be formed in a substantially similar manner to that described in connection with the machine compartment 30, or by a different process.

The formation of the machine compartment 30 in the rear surface 80 of the external wrapper 22 also forms the foot 54. The foot 54 is positioned below the machine compartment 30 and may form a bottom of the refrigerator 10. The foot 54 is composed of the bottom wall 42 of the machine compartment 30, the rear surface 80 of the external wrapper 22 and a base wall 100 of the external wrapper 22. As such, the foot 54 is integrally defined by the external wrapper 22. As the foot 54 is partially formed by the bottom wall 42, the foot 54 extends the length of, and as deep as, the machine compartment 30. The gap 26 extends into the foot 54 and as such, the foot 54 may be hollow. In examples where an insulator is present in the gap 26, the insulator may fill the foot 54. According to various examples, the foot 54 may be sufficiently rigid or stiff to at least partially support and/or stabilize the refrigerator 10. In examples where the machine compartment 30 is positioned higher on the external wrapper 22, the inner liner 18 may extend into the foot 54 (i.e., below the machine compartment 30).

It will be understood that although described as integrally formed from the external wrapper 22, the machine compartment 30 may alternatively be a separately formed and integral piece which is coupled to the external wrapper 22. For example, the machine compartment 30 may be deep-drawn into the appropriate shape and welded to the external wrapper 22. Such an example may be advantageous in balancing the practical limitations of deep-drawing while still reducing the overall number of welds used to form the machine compartment 30.

Use of the present disclosure may offer several advantages. First, by integrally forming the machine compartment 30 from the external wrapper 22, the likelihood of air leaks into the gap 26 is reduced. For example, traditional refrigerators may suffer from multiple weld locations (e.g., to form a machine space or other shape) which may provide potential locations for air exchange between the environment and the cabinet, thereby reducing insulating efficiency. Use of the deep-drawing process allows for the elimination of potential leak points by integrally forming the machine compartment 30 and its walls from the external wrapper 22. Second, deep drawing of the machine compartment 30 may reduce the cost (e.g., related to manufacturing time and part cost) of the refrigerator 10. For example, as the machine compartment 30 is formed from a single piece of material, costs associated with multiple components and their manufacturing time may be eliminated. Third, formation of the foot 54 may allow for the reduction, or elimination, of traditional support mechanisms. For example, in traditional refrigerators, exterior wrappers may be slanted inward such that machine spaces may be positioned below or exterior to the exterior wrapper. In such configurations, a separate support component may be positioned across the machine space to provide stability to the refrigerator. Use of the integrally defined machine compartment 30 allows for the formation of the foot 54 which provides stability and support to the refrigerator 10. Further, as the foot 54 is formed at the same time as the machine compartment 30, additional manufacturing time may be eliminated. Fifth, vacuum insulated cabinets 14, panels and structures may provide enhanced insulative properties as compared to traditional foam filled insulating structures in addition to a reduced size (e.g., thickness decrease of greater than about 55%, 60% or 70%). Sixth, as explained above, it will be understood that the present disclosure is not limited to cabinets for refrigerators, but may be used to from a variety of panels, structures and containers which have insulative properties. It will be understood that although the disclosure was described in terms of a refrigerator, the disclosure may equally be applied to coolers, ovens, dishwashers, laundry applications, water heaters, household insulation systems, ductwork and other applications.

Modifications of the disclosure will occur to those skilled in the art and to those who make or use the disclosure. Therefore, it is understood that the embodiments shown in the drawings and described above are merely for illustrative purposes and not intended to limit the scope of the disclosure, which is defined by the following claims as interpreted according to the principles of patent law, including the doctrine of equivalents.

It will be understood by one having ordinary skill in the art that construction of the described disclosure and other components, is not limited to any specific material. Other exemplary embodiments of the disclosure disclosed herein may be formed from a wide variety of materials, unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature, or may be removable or releasable in nature, unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the system may be varied, and the nature or numeral of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes, or steps within described processes, may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further, it is to be understood that such concepts are intended to be covered by the following claims, unless these claims, by their language, expressly state otherwise. Further, the claims as set forth below, are incorporated into and constitute part of this Detailed Description.

What is claimed is:

1. A refrigerator cabinet comprising:

an inner liner;

an external wrapper, the inner liner positioned within the external wrapper such that a gap is defined between the external wrapper and the inner liner, wherein the external wrapper includes a machine compartment comprising:

a top wall;

an interior wall;

a bottom wall;

a first side wall; and a second side wall, wherein the top wall, the interior wall, the bottom wall, the first side wall, and the second side wall are integrally formed as a single unitary construction with the external wrapper to define the machine compartment; and a foot integrally formed by the external wrapper and positioned below the machine compartment, wherein the foot is at least partially defined by the bottom wall and at least partially supports the refrigerator cabinet.

2. The cabinet of claim 1, wherein the foot is partially defined by a base wall of the external wrapper.

3. The cabinet of claim 2, wherein the base wall and the bottom wall are substantially parallel and the foot is hollow.

4. The cabinet of claim 3, wherein the interior wall of the machine compartment is spaced apart from the inner liner.

5. The cabinet of claim 1, wherein the top wall has a greater depth than the bottom wall.

6. The cabinet of claim 1, wherein the gap has a pressure of less than about 1000 Pa.

7. The cabinet of claim 1, wherein the foot extends the length of the machine compartment.

8. The cabinet of claim 6, wherein the top wall is angled with respect to the bottom wall.

* * * * *